United States Patent [19]

Raubenheimer

[11] Patent Number: 4,521,933

[45] Date of Patent: Jun. 11, 1985

[54] RANDOM STEERING DEVICE FOR A SUBMERGED SUCTION CLEANING HEAD

[75] Inventor: Johann N. Raubenheimer, Johannesburg, South Africa

[73] Assignee: Johann Nicolaas Raubenheimer, Johannesburg, South Africa

[21] Appl. No.: 604,450

[22] Filed: Apr. 30, 1984

Related U.S. Application Data

[63] Continuation of Ser. No. 422,160, Sep. 23, 1982, abandoned.

[30] Foreign Application Priority Data

Sep. 24, 1981 [ZA] South Africa ..... 81/6630
Apr. 2, 1982 [ZA] South Africa ..... 82/2293

[51] Int. Cl.[3] ..... E04H 3/20
[52] U.S. Cl. ..... 15/1.7; 134/21
[58] Field of Search ..... 134/18, 21, 22.18; 15/1.7

[56] References Cited

U.S. PATENT DOCUMENTS 3,803,658 4/1974 Raubenheimer ..... 15/1.7
3,928,202 12/1975 Raubenheimer ..... 15/1.7 X
4,208,752 6/1980 Hofmann ..... 15/1.7

FOREIGN PATENT DOCUMENTS 2612043 9/1977 Fed. Rep. of Germany ..... 15/1.7

*Primary Examiner*—Marc L. Caroff
*Attorney, Agent, or Firm*—Ladas & Parry

[57] ABSTRACT

An apparatus is provided for the random steering of a suction head for cleaning swimming pools in which there is a suction hose connecting with the head in a direction normal to the surface on which the suction head moves. The apparatus operates by intermittently applying torque about the axis of the suction hose, e.g. where it enters the suction head. The torque is applied by means of a water motor driven by the water flowing from the suction head along the suction hose.

3 Claims, 2 Drawing Figures

RANDOM STEERING DEVICE FOR A SUBMERGED SUCTION CLEANING HEAD

This application is a continuation of application Ser. No. 422,160, filed Sept., 23, 1982, now abandoned.

BACKGROUND TO THE INVENTION

This invention relates to a control device for submerged surface cleaning apparatus.

One type of device for cleaning submerged surfaces, such as the floors of swimming pools comprises a cleaning head which is connected by means of a flexible suction hose to the suction side of a filter-pump combination. Liquid flowing through the suction head and along the suction hose powers a device which causes the suction head to move along the submerged surface. In the course of moving along the suction head momentarily detaches itself from the latter surface so that it advances in a stepwise manner.

Suction heads of this kind are described, for example, in U.S. Pat. No. 4,434,519. Some of these suction heads tend to move in a straight line and have no facility for changing direction. Ideally a suction head of this kind should move as randomly as possible over a swimming pool surface. Also, if it runs up against a barrier, a mechanism should exist for getting it to move away from that barrier. Random steering would have that effect.

An object of the invention is to apply random steering forces to a suction head in the course of its progress over a submerged surface.

SUMMARY OF THE INVENTION

A steering device according to the invention comprises:

- a housing adapted to be caused to travel over a surface to be cleaned,
- a spigot for attachment to a suction hose end journalled for rotation relatively to the housing, and having its axis normal to the surface,
- a drive gear fast with the spigot,
- a passage through the housing to provide a main path of flow for liquid flowing through the suction hose,
- a bypass to the main path of flow,
- a water turbine positioned in the bypass and caused to rotate by liquid flowing in the bypass,
- a gear train between the turbine and the drive gear; and
- means for intermittently blocking and unblocking the bypass so that the turbine applies torque to the drive gear intermittently and for short periods of tlime.

DESCRIPTION OF A PREFERRED EMBODIMENT

Figure 1:
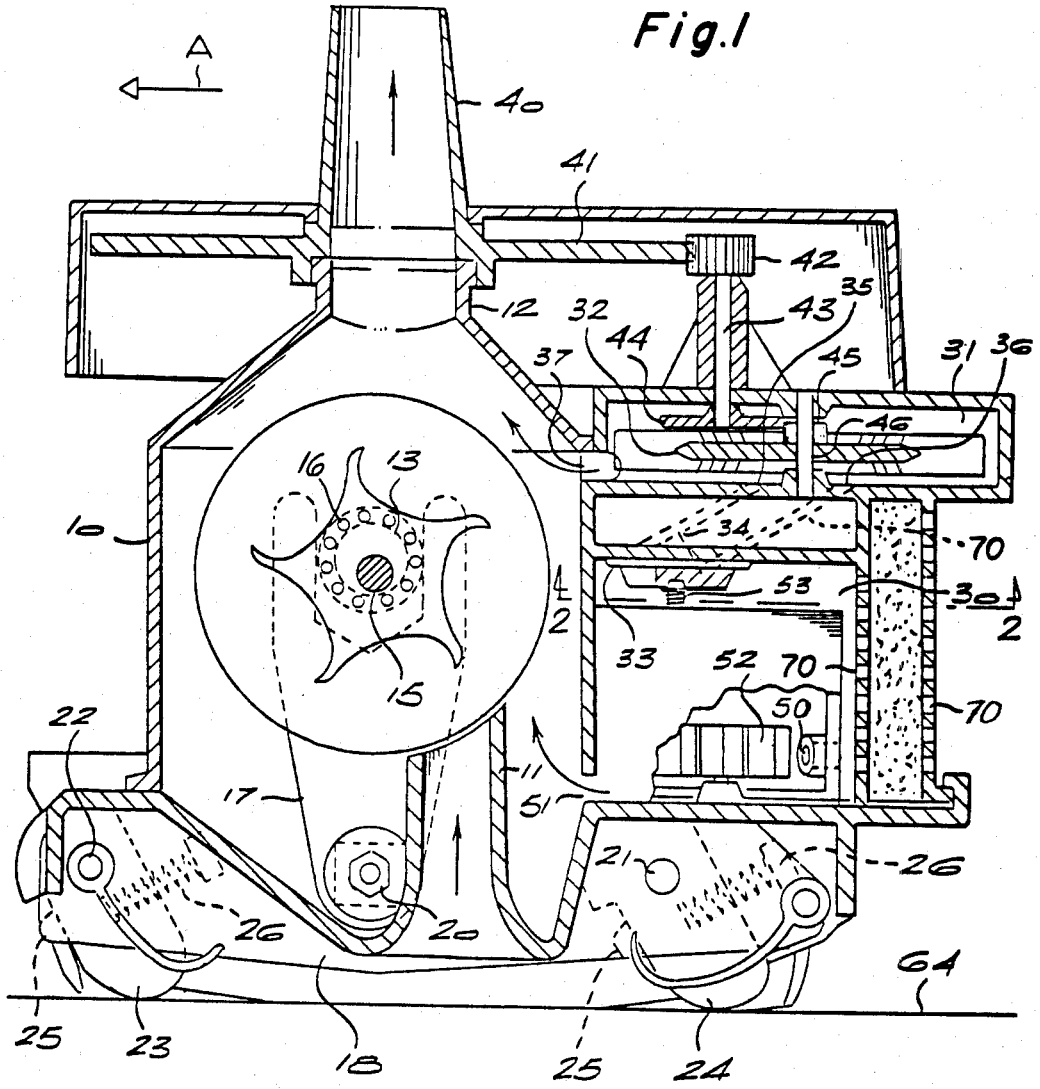
FIG. 1 is a section through a steerable suction head.
Figure 2:
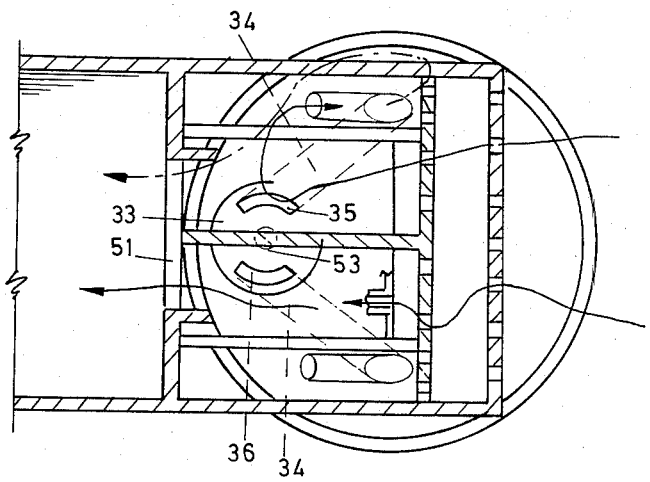
FIG. 2 is a section on the line 2—2 in FIG. 1.

The illustrated suction head has a housing 10 formed at its base with an inlet nozzle 11 and at its top with an outlet 12. A turbine 13 is housed in the housing 10 and journalled to the housing walls by means of bearings on the turbine shaft 15. It will be seen that if water flows from the nozzle 11 to the outlet 12, the turbine 13 will rotate.

Also on the shaft 15 are eccentric bearings 16 the outer races of which are slide fits in cleviced supports 17. As the shaft 15 rotates, the supports 17 will rock to and fro. Each support 17 is integral with a side frame 18 to which it is connected by means of a sleeve and a clamping bolt 20. The sleeve is journalled for rotation in the housing. If the supports 17 rock, this movement is imparted to the side frames.

The side frames are connected together by means of shafts 21 and 22 so that together they form a bogie. Pivoted on the shafts 21 and 22 are pairs of feet 23 and 24 made of a friction material such as rubber and engaged with a surface 64. Stops 25 limit the pivotal movement of the feet and springs 26 bias them against the stops 25 so that they assume the inclination relatively to a supporting surface as shown.

The result is that as the turbine 13 rotates, the bogie rocks and the whole device moves to the left in the direction of the arrow A in FIG. 1. This mechanism forms the subject matter of U.S. application Ser. No. 480,360 filed Mar. 30, 1983.

Attached to the housing 10 are two compartments 30 and 31. In the upper compartment 31 there is a reversible turbine 32. Two inclined passages 34 port in the compartment 30 and in the compartment 31 at the ports 35 and 36. The ports in the compartment 30 are controlled by a valve plate 33 the operation of which will be described later on. The outlet from the compartment 31 is at 37. The inlet to the compartment 30 is formed with two spaced perforated walls 70 between which is housed a filter medium such as stainless steel wool. Water can thus reach the ports in the compartment 30.

On the outlet 12 there is rotatably mounted a hose connection 40 which has its axis normal to the surface 64 and which carries a large gear wheel 41. A pinion 42 on a shaft 43 meshes with the gear wheel 41. At its lower end the shaft 43 carries a gear 44 which meshes with a pinion 45 on the shaft 46 of the turbine 32. If the turbine 32 rotates, it will thus apply a high slow speed torque to the connection 40.

In the compartment 30 there is also housed a water motor of the type used with oscillating sprinklers and geared down to give a reduction of the order of 2000:1. Water passing through the walls 70 enter the motor through an inlet 50 and passes into the housing 10 through an outlet 51. The rotor of the water motor has been shown as 52 in FIG. 1. The ultimate output of the motor 52 is at a shaft 53 which drives the valve plate 33 which is resiliently biased upwardly.

As the motor 52 rotates the valve plate 33 alternately covers and uncovers the ports 35 and 36 with relatively long periods when both ports are covered. As a port 35 or 36 is uncovered the turbine 32 applies a torque to the connection 40 which is in use attached to a flexible hose. The hose will resist or store the turning movement and the net effect is that the whole device immediately turns around the axis of the connection 40 or does so at the next rocking movement. When the then open port is closed, the device will be facing a random new direction. Of course, the running of the turbine 13 will constantly tend to move the device in its forward direction at any given time so that in turn a sort of spiral movement will take place. This is only readily feasible if, as described above the axis of the connection 40 is substantially normal to the surface 64.

I claim:

1. A suction cleaning device for cleaning submerged surfaces connected to a suction system by means of a flexible suction hose comprising: a housing adapted to be caused to travel over a surface to be cleaned, a spigot attached to said suction hose and journalled in the housing for rotation relative to the housing and having its axis normal to the surface in use; a drive gear fixed to the spigot; a passage through the housing to provide a first path of flow for liquid flowing to the suction hose; a first turbine in the housing rotated by flow of liquid through the passage; inclined friction feet pivoted on the housing and biased in a position to be actuated by the first turbine to cause the housing to move by a rocking action; a bypass passage through the housing to provide a second path of flow for liquid flowing to the suction hose; a second turbine positioned in the bypass and caused to rotate by liquid flowing in the bypass; a gear train between the second turbine and the drive gear; and means for intermittently blocking and unblocking the bypass so that the second turbine applies torque to the drive gear intermittently and for short periods of time.

2. The device claimed in claim 1 in which the bypass has two branches, each arranged to cause the second turbine to rotate in another direction and in which the bypass blocking and unblocking means alternately unblocks one or the other of said branches.

3. The device claimed in claim 2 in which the blocking and unblocking means is a valve plate driven at a slow speed by a water motor also actuated by liquid flowing in the bypass.

* * * * *